United States Patent [19]

Greer

[11] Patent Number: 4,493,477

[45] Date of Patent: Jan. 15, 1985

[54] CARPENTERS TOOL

[76] Inventor: Robert E. Greer, R.D. #3, Glen Rock, Pa. 17327

[21] Appl. No.: 527,268

[22] Filed: Aug. 29, 1983

[51] Int. Cl.[3] ..... B66F 3/00

[52] U.S. Cl. ..... 254/15; 145/1 B; 254/113

[58] Field of Search ..... 254/15, 16, 113; 145/1 B, 1 R

[56] References Cited

U.S. PATENT DOCUMENTS

| | | | |
|---|---|---|---|
| 300,968 | 6/1884 | Hatfield | 254/15 |
| 357,644 | 2/1887 | Tucker | 254/15 |
| 1,018,070 | 2/1912 | Morehead | 254/15 |
| 1,199,454 | 9/1916 | DeVries | 254/15 |
| 1,414,878 | 5/1922 | Howe | 254/15 |
| 2,132,553 | 10/1938 | Andrejchak | 254/15 |
| 2,718,375 | 9/1955 | Purdy | 254/15 |
| 4,290,582 | 9/1981 | Eckelkamp | 254/15 |

*Primary Examiner*—James G. Smith
*Assistant Examiner*—J. T. Zatarga
*Attorney, Agent, or Firm*—Charles J. Long

[57] ABSTRACT

A carpenter's tool for use in construction of wood framed structures includes an elongated handle having one end sharpened for penetration into wood and a bar pivoted to the handle adjacent the sharpened end. A sharpened member at the outer extremity of the bar has a tip extending in the direction of the sharpened end of the handle. An L-shaped hook may also be attached to the handle, preferably on the side opposite the bar side. The tool is useful in enabling one person to adjust the position of a warped or twisted wood structural member with one hand, leaving the other hand free to fasten the member in the correct position.

5 Claims, 5 Drawing Figures

CARPENTERS TOOL

BRIEF SUMMARY OF THE INVENTION

This invention relates to a carpenter's tool. More particularly, it relates to a carpenter's tool for use in construction of wood frame structures and the like.

In constructing wood frame structures the most commonly used lumber is known as "two-by" lumber, having a nominal thickness of 2" (although actual thickness is generally $1\frac{3}{8}$" to $1\frac{1}{2}$"), nominal widths from 2" to 12" (again, actual widths are less than nominal width) and lengths which vary to suit the particular structure being built. In addition, frequent use is made of plywood of various dimensions, e.g. for subfloors and the like.

Construction of the frame of a wood framed structure is generally begun by fastening a series of "two-by" members to the horizontal top of a concrete or masonry foundation wall, with their thickness dimensions vertical and width dimensions horizontal. Occasionally these horizontal members, known as "plates", are bowed in the lengthwise direction and portions of them must be shifted small distances and held in place while being fastened in order to insure that the finished wall will be straight.

As construction progresses, other "two-by" members having their width dimensions vertical are installed parallel to one another as floor joints. Typically, the ends of a series of floor joists are connected and held in position by a "ribbon board", another "two-by" member having the same width as the joists. Often either a ribbon board or a joist will be slightly bowed or twisted, such that the one must be moved relative to the other and held in position while being nailed so that correct structural relationships can be maintained.

Heretofore such minor positioning adjustments as described above have generally required two workers, one to move the member and hold it in place, for example by using a crowbar, and the other to nail or otherwise fasten the member to the adjacent structure.

I have invented a carpenter's tool which enables one worker to use one hand to adjust and hold the position of a bowed or twisted wood structural member and the other hand to hammer a nail or the like through the member to permanently hold it in the correct position.

In accordance with the invention, I provide a carpenter's tool for use in construction of wood-framed structures, comprising (a) an elongated handle having one end sharpened for penetration into wood, (b) a bar pivoted to the handle adjacent the sharpened end for pivoting about an axis perpendicular to the longitudinal axis of the handle, and (c) a sharpened member mounted at the outer extremity of the bar and generally at a right angle thereto, the tip of the member extending in the direction of the sharpened end of the handle.

Preferably, the distance from the pivot axis of the bar to the tip of the sharpened member is from about one to about three times the distance from the pivot axis to the tip of the sharpened end of the handle.

For improved results, the sharpened member extends from the bar a distance equal to from about 1/6 to $\frac{1}{3}$ the distance from the pivot axis to the tip of said member.

In a preferred embodiment, the handle is of rectangular transverse cross section and the bar extends from one of the sides thereof. In this embodiment, the one end of the handle is preferably sharpened to form a first wedge having converging flat outer and inner faces, and for best results the side of the handle from which the bar extends constitutes the outer face of the first wedge. The angle between the faces of the first wedge is preferably from about 18 to about 25 degrees.

For improved effectiveness, the sharpened end of the handle may include a second sharpened wedge having converging flat outer and inner faces, the side of the handle opposite the bar constituting the outer face. Preferably, the angle between the faces of the second wedge is such that the inner faces of the first and second wedges intersect to form an angle of about 90 degrees.

I further prefer that the sharpened member be of rectangular transverse cross section and be sharpened to form a wedge having two flat converging faces perpendicular to the longitudinal axis of the bar, the face nearest the handle forming an angle from about 70 to about 80 degrees with a line drawn from the pivot axis to the tip of the wedge; here again, the angle between the faces of the wedge should preferably be between about 18 and 25 degrees.

To provide for removing twists from structural members, the tool of my invention may include an L-shaped hook attached to the handle at a point spaced from the sharpened end by a distance equal to about one-half the maximum width of the structural members with which the tool is to be used, the hook being perpendicular to the handle at the point of attachment and extending from the handle a distance equal to from about 1.1 to about 1.4 times the maximum thickness of the structural members with which the tool is to be used, at which point it makes a right angle bend and extends in the direction of the sharpened end for a distance of between about $\frac{3}{4}$ inch and about 2 inches.

BRIEF DESCRIPTION OF THE DRAWINGS

In the accompanying drawings I have shown a certain present preferred embodiment of the invention in which.

DESCRIPTION OF THE PREFERRED EMBODIMENT

Figure 1:
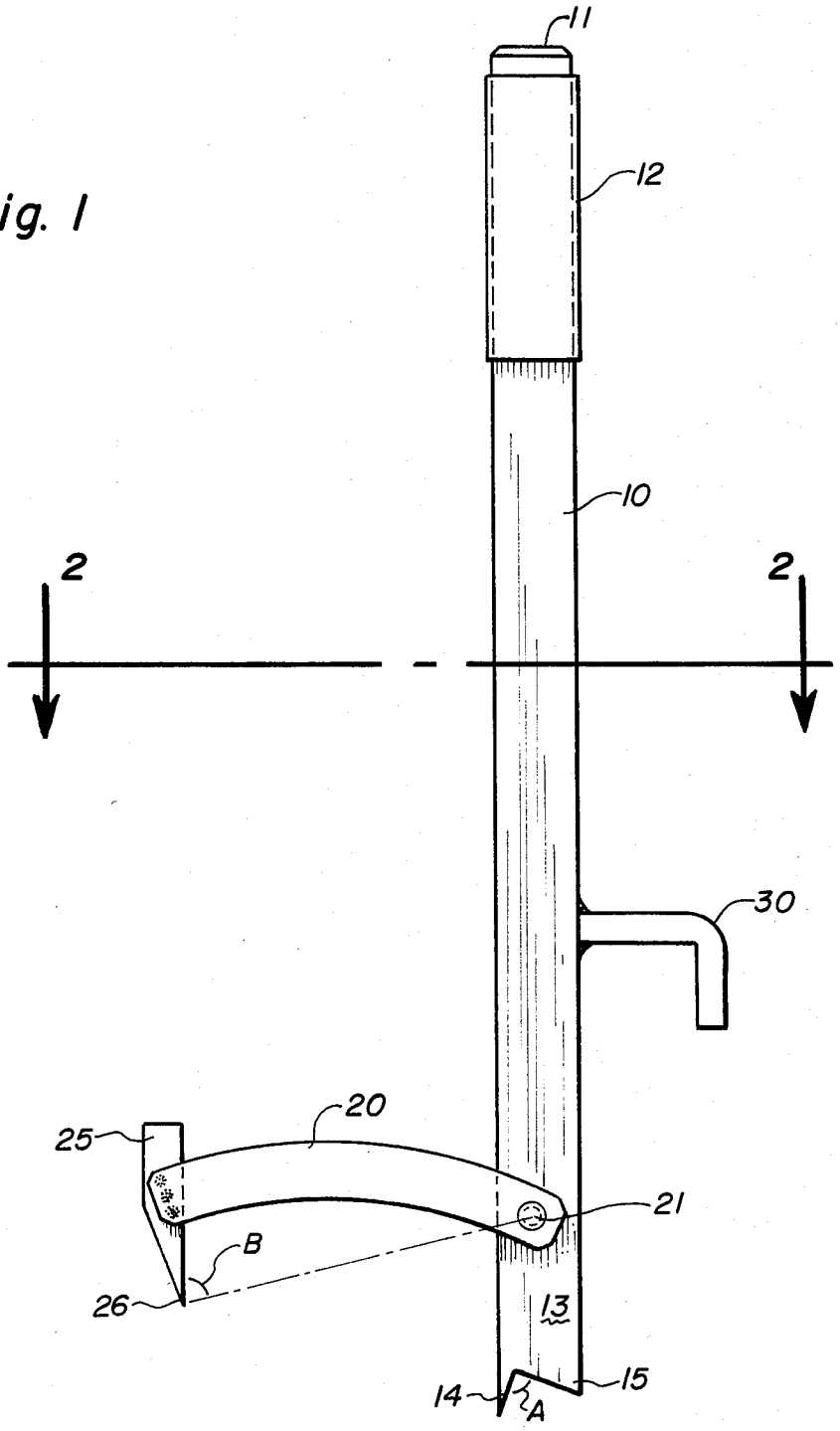
FIG. 1 is a side view of a carpenter's tool according to the invention.
Figure 2:
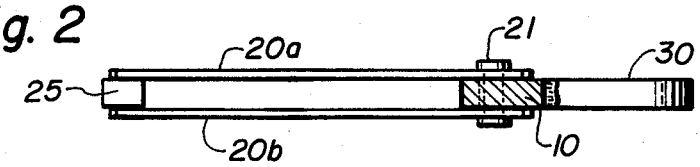
FIG. 2 is a top view taken along the line 2—2 of FIG. 1 and illustrating structural details of a preferred tool.

Turning first to FIGS. 1 and 2, the carpenter's tool of my invention comprises an elongated handle 10; although other dimensions, shapes (e.g. cylindrical) and materials can be used satisfactorily, in the preferred embodiment illustrated the handle 10 is formed from carbon steel bar having a $\frac{3}{8}$ inch by 1 inch rectangular cross section and cut to an overall length of about 18 inches. One end 11 of the handle is beveled and hardened to resist hammer blows; in addition, at this end shrink-fit plastic or other suitable material may be used to provide a grip 12.

The other end of the handle, designated generally by the numeral 13, is sharpened for penetration into wood. I have found that optimum results are obtained when the end is sharpened to form two wedges 14 and 15, each of which has converging flat outer and inner faces. Opposite sides of the handle 13 constitute the outer faces of wedges 14 and 15 respectively. The faces of wedge 14 form an angle of from about 18 to about 25 degrees, preferably about 20 degrees, which I have found to be best for allowing some penetration while minimizing damage to the wood. The faces of wedge 15 form an angle which is the complement of the angle formed by the faces of wedge 14, so that the inner faces of the two wedges intersect to form an angle A of about 90 degrees; this configuration provides both ease in fabrication and improved utility, as will be apparent in the description of FIG. 3.

A bar 20 is pivoted to handle 10 adjacent the sharpened end 13 for pivoting about an axis 21 perpendicular to the longitudinal axis of the handle 10. A sharpened member 25 is mounted at the outer extremity of bar 20 and generally at a right angle to the bar; the tip 26 of the sharpened member extends in the direction of the sharpened end 13 of handle 10.

For best utility, the distance from the pivot axis 21 to the tip 26 of sharpened member 25 (illustrated by the dashed line shown in FIG. 1) is from about 1 to about 3 times, preferably about 1.7 times, the distance from the pivot axis 21 to the tip of wedge 14, the sharpened end of the handle; in a typical tool the distance from axis 21 to tip 26 may be about $4\frac{3}{4}$ inches, and that from axis 21 to the tip of wedge 14 may be about $2\frac{3}{4}$ inches.

I have also found that improved results are obtained when the distance from tip 26 to bar 20 is about 1/6 to about $\frac{1}{3}$ the distance from tip 26 to the pivot axis 21; in a typical tool in which tip 26 is about $4\frac{3}{4}$ inches from pivot axis 21, tip 26 is about 1 inch from bar 20. The length of bar 20 and location of pivot axis 26 are of course made suitable to provide the preferred ratios.

FIG. 2 shows a preferred structure of a tool according to the invention in which bar 20 comprises two slightly curved pieces of strip steel 20*a* and 20*b* secured on opposite sides of handle 10 by means of a rivet running through pivot axis 21; typically I may use $\frac{1}{8}$ inch by $\frac{3}{4}$ inch carbon steel strip for this purpose. It will of course be understood that although fabricated in two pieces, the bar as a whole extends from one of the narrower sides of handle 10. Although bar 20 could be straight, I prefer to fabricate it in a slightly curved shape as shown to provide some extra "head room" for structural members with which the tool may be used. Sharpened member 25 is preferably welded in position between the two pieces of strip steel as shown.

As shown in FIGS. 1 and 2, I prefer that sharpened member 25 be of rectangular cross section and be sharpened to form a wedge having two flat converging faces perpendicular to the longitudinal axis of bar 20, the face nearest handle 10 forming an angle B of from about 70 to about 80 degrees, preferably about 75 degrees, with a line drawn from pivot axis 21 to the tip 26 of the sharpened member. I have found that this angle provides the most effective utility of my tool in applications such as those shown in FIG. 3, to be discussed hereinafter, and minimizes damage to the wood from tearing by tip 26. As was true with wedge 14 at the end of handle 10, I have found that for best results the angle formed by the faces of the wedge of member 25 should be between about 18 and about 25 degrees, preferably about 20 degrees.

Both the sharpened member 25 and the end 13 of handle 10 are hardened by known means for improved wear resistance.

To provide utility of my carpenter's tool in additional areas, in particular that of removing twists from structural wood members, the tool as shown in the drawing figures also includes an L-shaped hook 30 attached to handle 10 at a point spaced from the sharpened end by a distance equal to about one-half the maximum width of structural members with which the tool is expected to be used. Typically, the largest such members are "two-by-twelves", the actual dimensions of which are typically $1\frac{3}{8}$ inches by $11\frac{3}{4}$ inches; in such case, the distance from the sharpened end to the point of hook attachment should be about $5\frac{7}{8}$ inches.

Hook 30 is perpendicular to handle 10 at the point of attachment, and it extends from the handle a distance equal to from about 1.1 to about 1.4, preferably about 1.3, times the maximum thickness of structural member with which the tool is to be used; for typical "two-by" members having an actual thickness of $1\frac{3}{8}$ inches, this distance is from about 1 9/16 inches to about 2 inches, preferably about $1\frac{5}{8}$ inches. At the end of the perpendicular portion, the hook makes a right angle bend and extends in the direction of the sharpened end 13 for a distance between $\frac{3}{4}$ inches and 2 inches, preferably about 1 inch; I have found that this length works well and if it is greater than 2 inches the hook is undesirably bulky. For hook 30 I may typically use $\frac{3}{8}$ inch square carbon steel stock. A hook shaped, sized and located as in the typical example described is useful with all commonly used "two-by" members.

Figure 5:
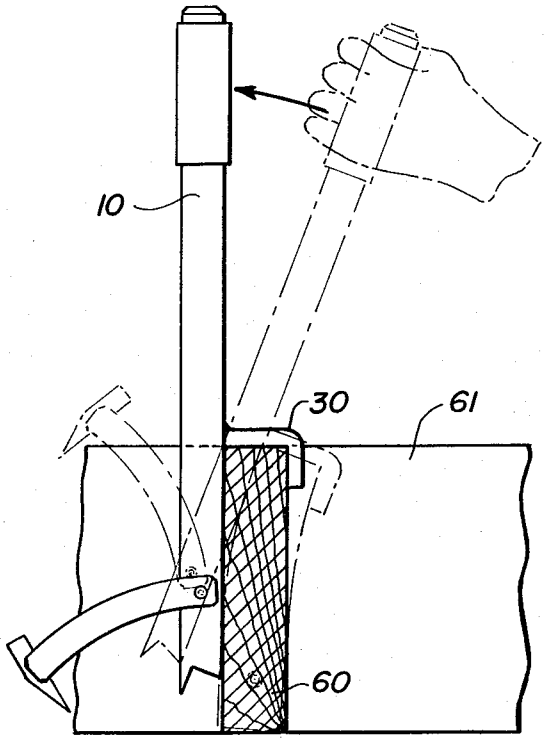
FIGS. 3, 4 and 5 illustrate uses of the tool in construction of wood-framed structures.
Figure 4:
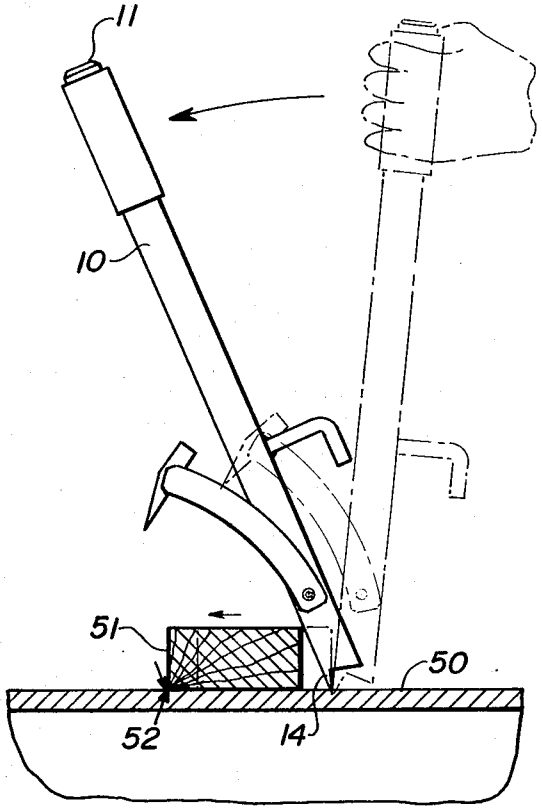
Figure 3:
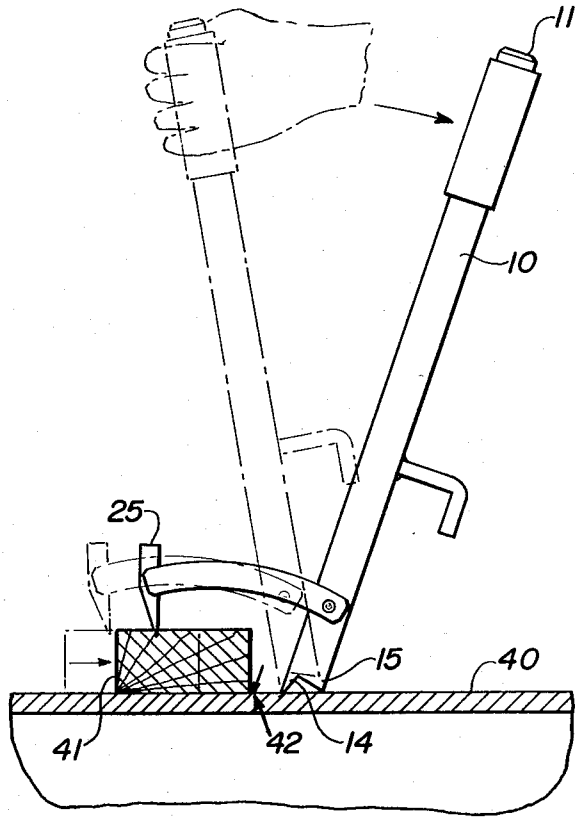

Turning now to FIGS. 3, 4 and 5, three uses of my improved carpenter's tool are shown. In all three drawing figures initial positions of the tool and the structural members are shown in broken lines and final positions are shown in solid lines.

In FIG. 3 there is shown a base structure 40, such as a subfloor, and a "two-by-four" plate 41 which is bowed so as to be spaced from its intended location, indicated by two small arrows 42. To use my carpenter's tool, the first wedge 14 is imbedded in base 40 by a light hammer tap on the grip end 11 of handle 10; next, the tip of sharpened member 25 is driven a small distance into plate 41, again using a light hammer tap. With the tool thus positioned, a carpenter can with one hand pull the tool in the appropriate direction, to the right viewing FIG. 3, to bring the plate into the correct position, and use the other hand to nail it in place. FIG. 3 also illustrates the advantage of having two wedges on the sharpened end 13 of handle 10. It will be noted that as the tool is pulled towards the right in the figure the second wedge 15 comes in contact with the base and thereby maintains traction when wedge 14 pulls out of the base.

In FIG. 4 a similar base 50 and plate 51 are shown, but here plate 51 must be pushed rather than pulled into position. In such case, the tool is initially positioned so that wedge 14 contacts the bottom edge of plate 51; wedge 14 is then imbedded in base 50 by a light hammer tap on the end 11. Thereafter the tool is pushed to the left viewing FIG. 4 and moves plate 51 into the correct position, again indicated by two small arrows 52, where the carpenter can nail it in place using his or her free hand.

In FIG. 5 use of the L-shaped hook 30 to remove a twist from a two-by-twelve joist 60 is shown. The hook is placed over the edge of the twisted joist with the handle 10 against the joist on the opposite side. The tool is then moved, to the left viewing FIG. 5, to remove the twist from the joist, at which time the straightened joist can be nailed in place, for example to ribbon board 61, with the carpenter's free hand.

FIGS. 3 through 5 illustrate only three of many uses for my carpenter's tool; additional possibilities can readily be envisioned by any carpenter experienced in building wood-framed structures. In almost all such applications the principal advantage of the tool is enabling one worker to align and true up structural members where two workers were needed heretofore.

While I have shown and described a certain present preferred embodiment of the invention, it is to be distinctly understood that the invention is not limited thereto but may be otherwise variously embodied within the scope of the following claims.

I claim:

1. A carpenter's tool for use in construction of wood-framed structures comprising:

(a) an elongated handle of rectangular transverse cross section having one end sharpened to form first and second wedges, each wedge having converging flat inner and outer faces, one side of the handle constituting the outer face of the first wedge, the side of the handle opposite said one side constituting the outer face of the second wedge, the angle between the faces of the first wedge being from about 18 degrees to about 25 degrees;

(b) a bar extending from said one side of the handle and pivoted to the handle adjacent the sharpened end for pivoting about a pivot axis perpendicular to the longitudinal axis of the handle; and (c) a sharpened member at the outer extremity of the bar and generally at a right angle thereto, the tip of the member extending in the direction of the sharpened end of the handle, the distance from the pivot axis to the tip of the sharpened member being (i) about one to about three times the distance from said axis to the tip of the first wedge and (ii) about three to about six times the distance from the tip of the sharpened member to the bar.

2. A tool as claimed in claim 1, in which the inner faces of the first and second wedges intersect to form a angle of about 90 degrees.

3. A tool as claimed in claim 2, in which the sharpened member is of rectangular transverse cross section and is sharpened to form a third wedge having two flat converging faces perpendicular to the longitudinal axis of the bar, the face nearest the handle forming an angle of from about 70 to about 80 degrees with a line drawn from the pivot axis to the tip of the third wedge.

4. A tool as claimed in claim 3 in which the angle between the faces of the third wedge is between about 18 and about 25 degrees.

5. A tool as claimed in claim 4 having a L-shaped hook attached to the handle at a point about $5\frac{7}{8}$ inches from the first wedge, the hook being perpendicular to the handle at the point of attachment and extending from the handle about 1 9/16 inches to about 2 inches, at which point it makes a right angle bend and extends about $\frac{3}{4}$ inch to about 2 inches in the direction of the sharpened end.

* * * * *